United States Patent [19]

Schumacher

[11] Patent Number: 4,978,889

[45] **Date of Patent: * Dec. 18, 1990**

[54] PLASMA WAVE TUBE AND METHOD

[75] Inventor: Robert W. Schumacher, Canoga Park, Calif.

[73] Assignee: Hughes Aircraft Company, Los Angeles, Calif.

[ * ] Notice: The portion of the term of this patent subsequent to Apr. 10, 2007 has been disclaimed.

[21] Appl. No.: 181,300

[22] Filed: Apr. 14, 1988

[51] Int. Cl.[5] ..... H01J 7/24; H01J 25/00

[52] U.S. Cl. ..... 315/111.21; 315/5; 315/39; 313/231.31

[58] Field of Search ..... 315/111.21, 111.41, 315/111.81, 111.91, 111.71, 4, 5, 39; 313/231.31, 231.41, 362.1, 156, 161; 250/423 R, 427

[56] References Cited

U.S. PATENT DOCUMENTS

| | | | |
|---|---|---|---|
| 3,313,979 | 4/1967 | Landauer | 315/39 |
| 3,418,206 | 12/1968 | Hall et al. | 315/39 |
| 3,508,268 | 4/1970 | Forman | 343/701 |
| 3,566,185 | 2/1971 | Gaum | 250/427 |
| 3,999,072 | 12/1976 | Takagi | 250/427 |
| 4,393,333 | 7/1983 | Sakudo et al. | 315/111.41 X |
| 4,728,862 | 3/1988 | Kovarik et al. | 315/111.41 X |
| 4,788,473 | 11/1988 | Mori et al. | 315/111.41 X |
| 4,800,281 | 1/1989 | Williamson | 250/427 |

OTHER PUBLICATIONS

Schumacher et al, "Scaling of Millimeter-Wave . . . Plasma-Filled Waveguide", 1987 IEEE Inter. Conf. on Plasma Science, Jun. 1-3, 1987, p. 41.

Schumacher et al, "Millimeter-Wave Generation Via Plasma Three-Wave Mixing", 1986 IEEE Inter. Conf. on Plasma Science, May 19-21, 1986, p. 68.

Eidson, "Coupling and Fast Waves in Electron Beam--Plasma Systems", Proc. of the National Electronic Conference, vol. XX, Oct. 19-21, 1964, pp. 84-87.

Santoru et al, "MM-Wave Generation Via Plasma Three-Wave Mixing", 28th Annual Meeting Division of Plasma Physics, Nov. 3-7, 1986.

Igor Alexeff et al, "Millimeter Microwave Emission from a Maser by Use of Plasma-Produced Electrons Orbiting a Positively Charged Wire", Physical Review Letters, vol. 45, No. 5, pp. 351-354, Aug. 4, 1980.

John Backus, "Studies of Cold Cathode Discharges in Magnetic Fields", Journal of Applied Physics, vol. 30, No. 12, pp. 1866-1869, Dec. 1959.

(List continued on next page.)

*Primary Examiner*—Eugene R. LaRoche
*Assistant Examiner*—Seung Ham
*Attorney, Agent, or Firm*—V. D. Duraiswamy; P. M. Coble; W. K. Denson-Low

[57] ABSTRACT

A plasma wave tube and associated operating method are described in which a pair of cold-cathode electron beam generators discharge counterpropagating electron beams into an ionizable gas, preferably hydrogen or a noble gas, within a waveguide housing. A voltage within the approximate range of 4-20 kV relative to the waveguide housing is applied to the cathodes to produce electron beams with current densities of at least about 1 amp/cm$^2$. The beams form a plasma within the gas and couple with the plasma to produce electron plasma waves, which are non-linearly coupled to radiate electromagnetic energy in the microwave to mm-wave region. A magnetic field is established within the waveguide between the cathodes to confine the plasma, and to control the beam discharge impedance. The gas pressure is held within the approximate range of 1-100 mTorr, preferably about 10-30 mTorr, to damp plasma instabilities and sustain the beam voltages, while the magnetic field is within the approximate range of 100-500 Gauss. A very rapid frequency slewing or chirping is achieved with a relatively high magnetic field that reduces the discharge impedance to the lower end of the permissible range. Frequency-stabilized operation is achieved with a lower magnetic field that increases the discharge impedance so that the beam current changes very slowly with time.

21 Claims, 4 Drawing Sheets

OTHER PUBLICATIONS

G. W. McClure, "Low-Pressure Glow Discharge", Applied Physics Letters, vol. 2, No. 12, pp. 233-234, Jun. 15, 1963.

D. Bohm et al, "Theory of Plasma Oscillations. A. Origin of Medium-Like Behavior", Physical Review, vol. 75, No. 12, pp. 1851-1864, Jun. 15, 1949.

A. V. Haeff, "Space-Charge Wave Amplification Effects", Physics Rev. 74, pp. 1532-1533, 1948.

M. A. Lampert, "Plasma Oscillations at Extremely High Frequencies", Journal of Applied Physics, vol. 27, No. 1, pp. 5-11, Jan. 1956.

A. D. Piliya, "Wave Conversion in an Inhomogeneous Plasma", Soviet Physics-Technical Physics, vol. 11, No. 5, pp. 609-614, Nov. 1966.

F. L. Hinton, "Collisionless Absorption and Emission of Electromagnetic Waves by a Bounded Plasma", The Physics of Fluids, vol. 10, No. 11, pp. 2408-2416, Nov. 1967.

T. J. M. Boyd, "Emission of Radio Noise by Plasmas", The Physics of Fluids, vol. 7, No. 1, pp. 59-63, Jan. 1964.

P. A. Sturrock et al, "Radiation at the Plasma Frequency and Its Harmonic from a Turbulent Plasma", The Physics of Fluids, vol. 8, No. 8, pp. 1509-1516, Aug. 1965.

R. E. Aamodt et al, "Non-Linear Coupling of Plasma Oscillations to Transverse Waves", Plasma Physics (Journal of Nuclear Energy Part C), 1964, vol. 6, pp. 147-151.

H. M. Skarsgard et al, "Enhanced Radiation Temperature at the Electron Plasma Frequency in a Nearly Maxwellian Plasma", Physical Review Letters, vol. 23, No. 18, pp. 1023-1026, Nov. 3, 1969.

C. Chin-Fatt et al, "Enhanced Radiation from a Theta-Pinch Plasma", Physical Review Letters, vol. 25, No. 24, pp. 1644-1646, Dec. 14, 1970.

L. D. Bollinger et al, "Experiments on the Relation Between Radiation and Fluctuation Spectrum of a Turbulent Plasma", Physical Review Letters, vol. 26, No. 10, pp. 535-538, Mar. 8, 1971.

M. Schneider et al, "Emission of Electromagnetic Waves at Frequencies Around Twice the Plasma Frequency in a Laboratory Plasma", Physics Letters, vol. 91A, No. 1, pp. 25-27, Aug. 16, 1982.

P. Y. Cheung et al, "Simultaneous Observation of Caviton Formation, Spiky Turbulence, and Electromagnetic Radiation", Physical Review Letters, vol. 48, No. 19, pp. 1348-1351, May 10, 1982.

P. Leung et al, "Observation of Electromagnetic Radiation at $2\omega_p$ Generated by Beam Interactions", Geophysical Monograph 25, 1981, pp. 387-392

R. W. Schumacher, "Millimeter-Wave Generation Via Plasma Three-Wave Mixing", Abstract submitted for the 277th Annual Meeting Division of Plasma Physics, Nov. 4-8, 1985.

PLASMA WAVE TUBE AND METHOD

BACKGROUND OF THE INVENTION

1. Field of the Invention

This invention relates to systems and methods for generating and propagating microwave to mm-wave electromagnetic radiation along a waveguide as a result of the nonlinear coupling of electron beam-driven electrostatic plasma waves within the waveguide.

2. Description of the Related Art

It would be highly desirable to be able to generate broadband, medium power (kilowatts) microwave to mm-wave radiation with a rapid frequency hopping and chirping capability over multiple octaves in frequency in a simple, low-cost and compact package. Keeping a device of this type light in weight would also be very important, since it would have various applications as a compact broadband transmitting mechanism for electronic warfare jamming applications. However, no devices have heretofore been developed that are capable of providing these functions in a satisfactory manner.

Various existing devices exist which might be considered for this application, but there are significant limitations to each. These include slow-wave devices such as travelling wave tubes, backward wave oscillators, magnetrons and Klystrons; fast-wave devices such as gyrotrons and free-electron lasers; and solid-state devices such as Gunn and IMPATT oscillators. The slow-wave devices produce too little mm-wave power, the fast-wave devices require very high voltages, high magnetic fields, and cannot be packaged compactly, while the solid-state devices provide narrow bandwidth and low power.

Another type of device, described in I. Alexeff and F. Dyer, Phys. Rev. Lett. 45, 351 (1980), is designated the orbitron maser. According to the authors, electrons are emitted from the inner surface of a cylinder by glow discharge, and are trapped in orbits about a thin wire which runs down the axis of a cylinder and has a positive voltage charge relative to the cylinder. The electrons drive a negative mass instability, which results in electron bunching. This in turn produces a space charge wave which couples to an electromagnetic waveguide mode. However, the orbitron maser requires highly fragile wire electrodes at mm-wave frequencies, and has too low an efficiency (in the order of about $10^{-6}$) for practical applications.

The injection of a powerful electron beam into a high-density plasma has previously been found to excite an electron plasma wave with a phase velocity less than the beam speed. The electron plasma wave is an electrostatic wave which oscillates at a frequency determined by the plasma density. The possibility of using the beam-plasma interaction to generate electromagnetic radiation was recognized when excitation of plasma waves by the two-stream instability was first discovered. However, the problem of coupling the RF energy out of the plasma prevented the development of practical sources or amplifiers based on this interaction. The coupling problem has its root in the fact that the RF energy is stored in an electron plasma wave which is purely electrostatic and trapped in the plasma. If the plasma is uniform, the electric field of each half-cycle of the wave accelerates the same number of electrons with alternating phase, so that no net source current is driven which can couple to an electromagnetic wave (electric field and density fluctuations are 90° out of phase).

More recently, however, experimental observations and advancements in plasma theory have shown that physical mechanisms exist which permit the conversion of electrostatic waves to electromagnetic waves inside the plasma, and the direct radiation of these waves with the plasma acting as an antenna. These processes require that the electron plasma waves interact with a density gradient or other plasma waves in a nonlinear wave-wave interaction in order to conserve momentum. The latter interaction is often called three-wave mixing, since it involves the coupling of two electrostatic plasma waves to generate an electromagnetic wave. Such mechanisms were originally proposed to explain bursts of radio emission from solar flares. Evidence of plasma radiation due to these processes has been observed in the laboratory. However, no way to exploit this phenomenon in a practical device that extends to the mm-wave range, with a practical efficiency in excess of $10^{-4}$, has heretofore been devised.

SUMMARY OF THE INVENTION

In view of the above limitations, the present invention seeks to provide an apparatus and method for generating waveguide electromagnetic radiation in the microwave to mm-wave range in a simple, low-cost, light weight and compact package, and with the capability of rapid frequency hopping and chirping.

This is accomplished with a simple waveguide housing within which a hydrogen or noble gas is confined at a pressure in the approximate range of 1–100 mTorr. Counterpropagating electron beams are directed through the gas by a pair of opposed cold-cathode Penning electron beam generators. The beams form a plasma within the gas, and mutually couple with the plasma to emit electromagnetic radiation along the waveguide. By maintaining the electron beam voltage at at least about 4 kV with a current density of at least 1 amp/cm$^2$, a threshold is passed beyond which a relatively high power, efficient output is realized. A magnetic field is established within the waveguide between the opposed beam-generating cathodes to confine the plasma to the vicinity of the beams, and to maintain the beam impedance high enough to sustain the necessary beam voltage. The magnetic field strength is preferably in the approximate range of 100–500 Gauss, while the gas pressure is preferably about 10–30 mTorr.

Frequency variation is achieved by varying the plasma density via the beam currents. One end of the waveguide housing is closed, with the beam generating apparatus located in the vicinity of the closed end so that the emitted electromagnetic radiation is reflected off the closed end and reinforces the radiation travelling in the opposite direction down the waveguide. The beam generating apparatus may be oriented with respect to the housing to establish any one of various possible waveguide propagation modes.

These and other features and advantages of the invention will be apparent to those skilled in the art from the following detailed description of preferred embodiments, taken together with the accompanying drawings, in which:

DETAILED DESCRIPTION OF PREFERRED EMBODIMENTS

Figure 1:
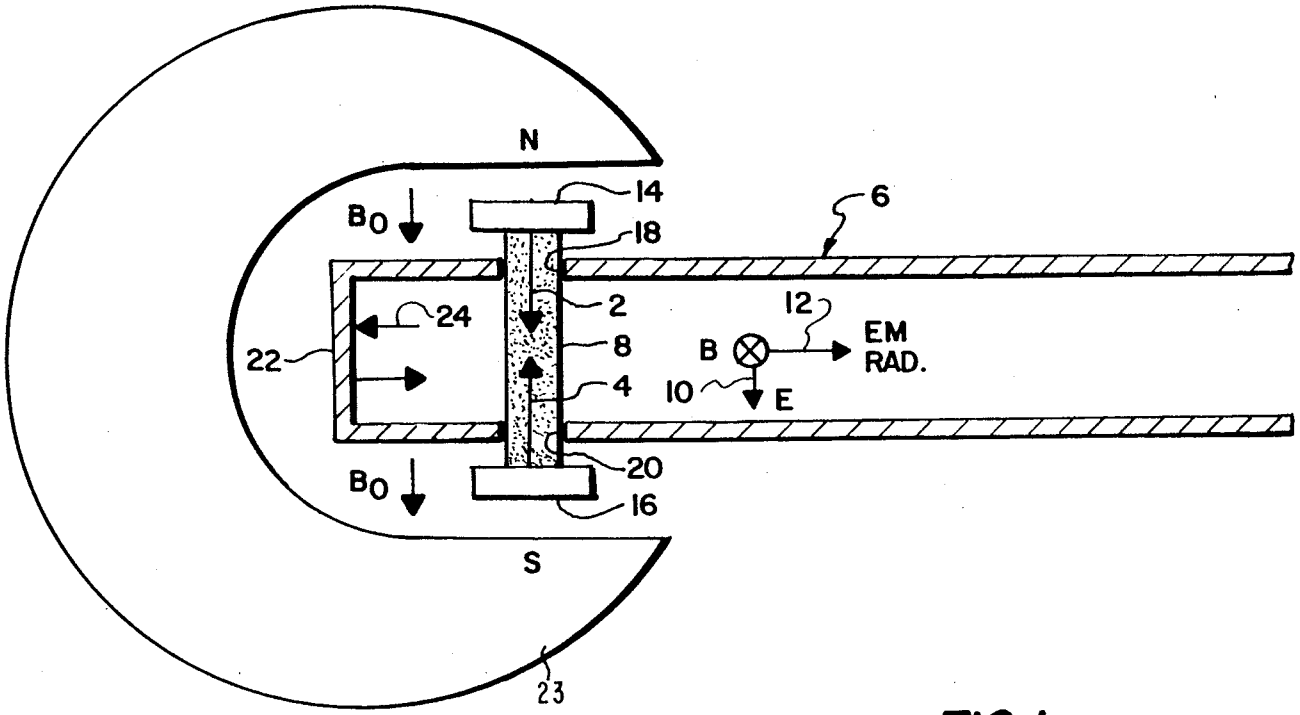
FIG. 1 is a diagram of a plasma wave tube constructed in accordance with the invention.

A preferred embodiment of the invention is illustrated in FIG. 1. The basic technique used in the invention is to inject a pair of counterpropagating electron beams 2,4 into a gas confined within a waveguide 6, thereby ionizing the gas to form a high density plasma 8. With the proper conditions, the two beams cross-couple with the plasma to excite a pair of anti-parallel electron plasma waves, which are electrostatic waves which oscillate at a frequency determined by the plasma density. Since the wavenumbers of the two electron plasma waves are found to match, the plasma electrons will be bunched in phase and a net nonlinear plasma current density will be generated. As a consequence of wave-energy conservation, this current oscillates at twice the plasma frequency. The oscillating current radiates an electromagnetic wave, with the electric field vector 10 polarized along the beam direction and the electromagnetic propagation direction 12 transverse to the beams. The use of cold-cathode Penning-discharge techniques permits the electron beam-plasma system to be confined inside a section of a rectangular waveguide 6. With a linear, magnetized plasma column across the shorter side of the rectangular waveguide, the ordinary $TE_{10}$ mode is excited and propagates outward in a direction perpendicular to the counterstreaming electron beams.

The use of cold-cathode electron guns eliminates various problems associated with conventional thermionic hot cathode devices, such as the requirement of a heater for the accompanying temperatures of about 1000° C., the requirement of a very high vacuum, and an incompatibility with most gases and plasma discharges. The Penning-discharge cold-cathode is described in an article by John Backus, "Studies of Cold Cathode Discharges in Magnetic Fields", *Journal of Applied Physics,* Vol. 30, No. 12, December 1959, pages 1866–69.

Cold-cathodes 14 and 16 are positioned on the outside of slots 18 and 20, respectively, which are cut along the wide section of the waveguide wall and are preferably about 1 cm. in length. They are preferably constructed from a non-magnetic, high conductivity, low work function and high melting point metal, particularly one of the refractory metals. Molybdenum or chromium are preferred, and stainless steel is also satisfactory. These cold cathodes perform the dual function of electron beam generation and plasma generation.

An ionizable gas, such as hydrogen, helium, neon or argon, is confined within the waveguide at a pressure in the approximate range of 1–100 mTorr, and preferably about 10–30 mTorr. This pressure range overcomes the problem of nonlinear instabilities taking energy out of the plasma waves and transferring it to the plasma particles at a very high rate. The relatively high pressure used in the invention is believed to significantly damp these instabilities, yielding power levels and efficiencies high enough to be useful. If the pressure is too high, however, the cathodes have difficulty in sustaining the relatively high voltages required. Whereas Penning discharges normally are produced at voltages within the range of 10–500 volts, typically about 100 volts, with the present invention a cathode voltage of at least about 4 kV relative to the waveguide housing is required; the cathode voltage is preferably not greater than 20 kV.

A magnetic field is produced by a device such as horseshoe magnet 23 to confine the plasma to the area between the two cathodes. With a magnetic field of about 100–500 Gauss, preferably about 250 Gauss, applied normal to the cathode surfaces, a glow discharge is established in the prescribed gas when a potential of at least about 4 kV is applied between the cathodes and the anode waveguide housing, with an accompanying electron beam current density of at least about 1 amp/cm$^2$. Plasma electrons are confined in the direction along the waveguide by the externally applied magnetic field, and are also confined electrostatically between the two cathodes by virtue of the negative cathode bias relative to the waveguide anode and plasma potentials. The magnetic field should not significantly exceed 500 Gauss, or excessive electron trapping and an inability to maintain adequate beam impedance may be encountered.

Normally, a glow discharge would regulate the voltage drop between the cathode and anode to about 200 volts, independent of the discharge current. Most of this discharge voltage appears across the cathode sheath. In this region ions are accelerated into the cathode surface with nearly 200 eV of energy, and cause secondary electrons to be emitted. These electrons are accelerated back through the sheath to the energy of the sheath voltage, and sustain a Penning discharge by impact ionization of the background gas atoms. The secondary electron current emitted by the cathode is less than the ion current incident upon the cathode by a factor called the secondary electron yield, which is usually between 0.01 and 1. The externally measured discharge current is therefore normally the sum of the incident ion current and the emitted secondary electron current.

In the waveguide configuration of FIG. 1, however, the secondary electron emission along the magnetic field lines effectively creates a pair of counterstreaming electron beams with beam energies about equal to the discharge voltage. These beams will drive electron plasma waves in the discharge. However, if the beam energy is kept in the normal glow discharge voltage range of about 200 volts, significant wave damping occurs and very little power is coupled to electromagnetic radiation. With the present invention, on the other hand, it has been discovered that the relationship between output power, discharge voltage and beam current density is nonlinear, and that beyond a certain threshold voltage and current density, output power increases very rapidly. The threshold voltage and current density levels have been determined to be about 4 kV and 1 amp/cm$^2$, respectively. If the discharge voltage is sustained at about 4 kV or above, then the electron plasma waves driven by the high energy beams are non-resonant with the background plasma electrons, and intense electron plasma wave fields can be sustained in the discharge column. Significant electron plasma wave power may thus be coupled to electromagnetic radiation fields.

A discharge voltage in the range of about 4–20 kV can be maintained if the Penning-discharge impedance is made significantly higher than the output impedance of the discharge power supply. A high discharge impedance can be obtained by using stainless steel cathode surfaces that are kept relatively clean of oxide impurities, such that the secondary electron yield is reduced to a relatively low value, preferably on the order of a factor of about 0.1. In addition, a high discharge impedance is aided by the application of relatively low magnetic field strengths, such that high energy electron trapping is just barely effective. Under these conditions, the discharge appears resistive rather than voltage regulating, and the discharge voltage can be controlled at the level of the external cathode power supply.

In the described high discharge impedance regime, the waveguide system of FIG. 1 is observed to generate significant electromagnetic radiation. The counter-streaming electron plasma waves in the beam-plasma discharge column 8 generate a radiation field in which the electric field vector is polarized in the direction along the column. The radiation then propagates down the guide in the $TE_{10}$ waveguide mode at a frequency well above cutoff. Radiation in the frequency range of 10–140 GHz has been generated with this technique in an X-band waveguide.

The waveguide housing is preferably closed at one end by a wall 22 in the general vicinity of the cathodes 14, 16. Electromagnetic radiation directed toward the left side of the waveguide is thus reflected off wall 22, as indicated by arrows 24, to reinforce the output radiation travelling to the right.

Figures 2, 3:
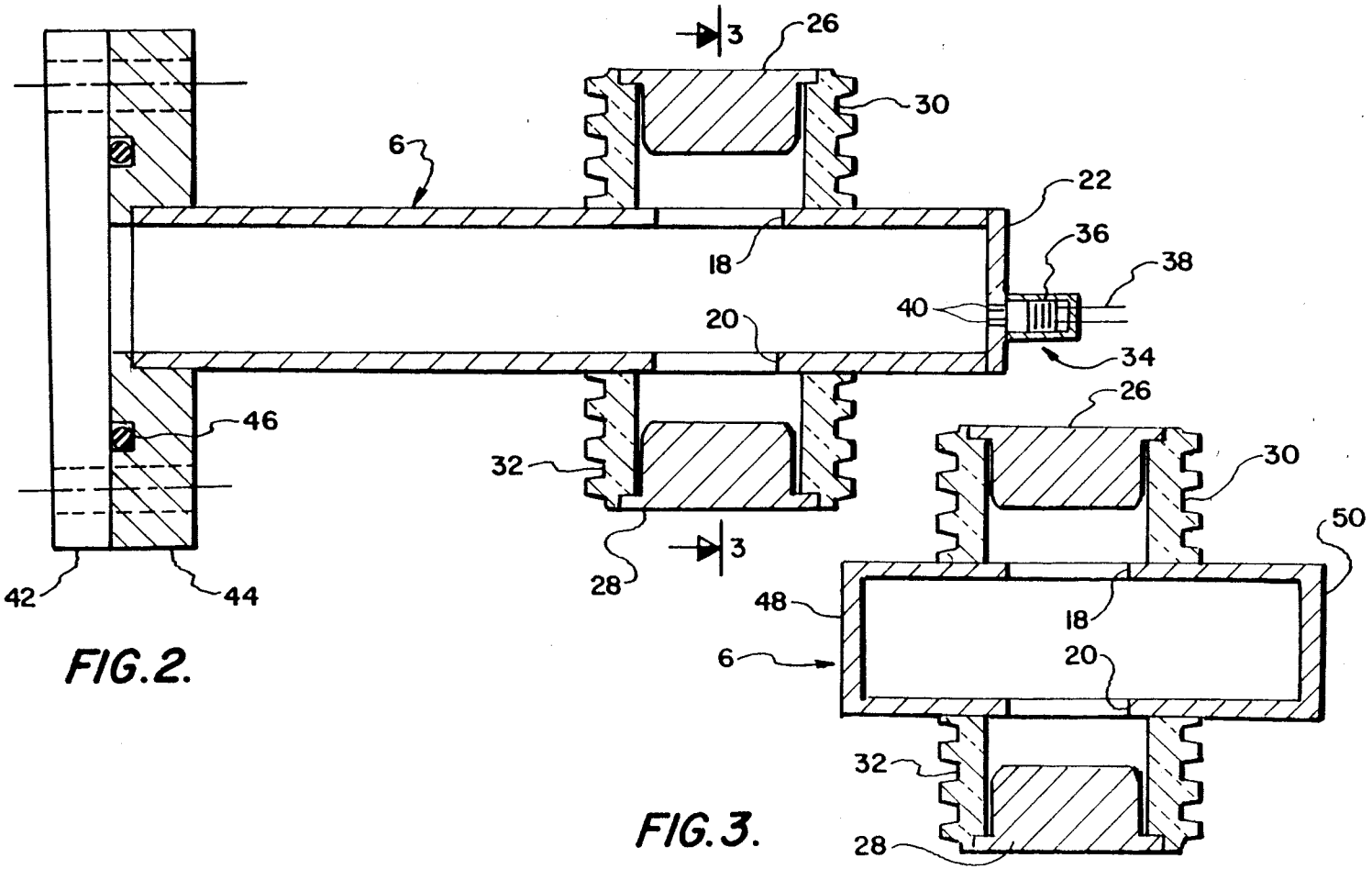
FIG. 2 is a sectional view of the waveguide structure incorporated in the plasma wave tube of FIG. 1.
FIG. 3 is a sectional view taken along the line 3—3 of FIG. 2.

Further structural elements of the waveguide are shown in FIGS. 2 and 3. The cathodes consist of a pair of stainless steel "buttons" 26, 28, which are supported by respective ceramic insulating bushings 30, 32, and positioned respectively behind slots 18 and 20. The waveguide is evacuated with a turbomolecular pump through an array of microperforations in the waveguide wall (not shown), and hydrogen gas is introduced to raise the pressure within the waveguide to the 10–30 mTorr range. For this purpose a $ZrH_2$ gas reservoir 34 is attached to the outside of end wall 22. An internal coil heater 36 within the reservoir is heated by a current flowing along input/output lead wires 38, and emits hydrogen into the waveguide through perforations 40. Alternately, a gas bottle reservoir and leak valve arrangement could be used. Electromagnetic radiation is coupled out of the waveguide through a quartz window 42, which is attached to an output flange 44 on the waveguide and sealed by an 0-ring 46.

FIG. 3 shows the orientation of cathodes 26, 28, which are positioned opposite each other across the narrow dimension of the rectangular waveguide to excite the fundamental $TE_{10}$ waveguide mode. As a practical lower limit to the waveguide dimensions, enough space must be left between the cathode slots, 18,20 for ionization to take place; it is believed that at least about 3 mm is required.

Figure 4:
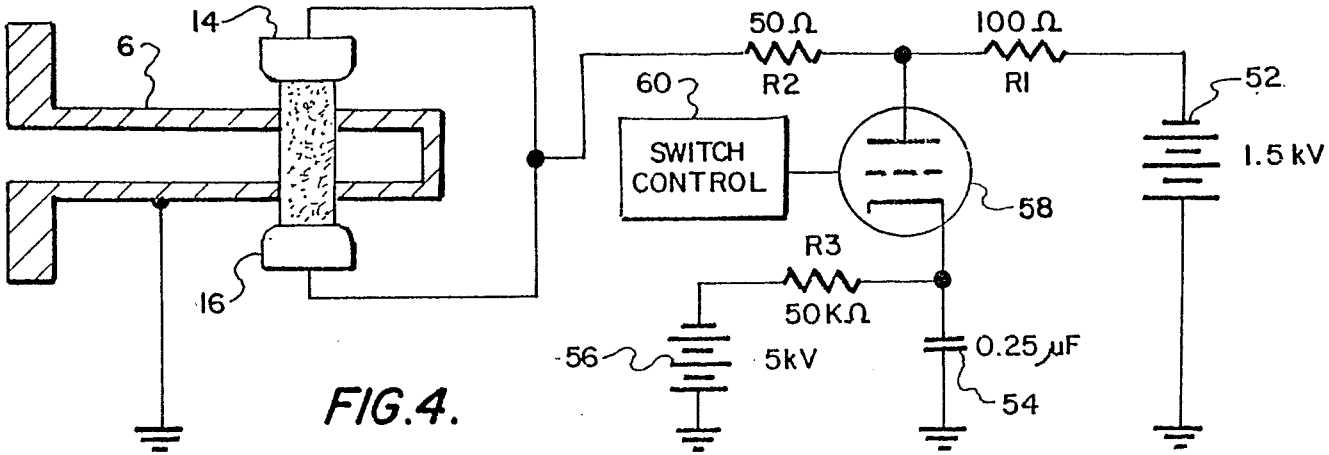
FIG. 4 is a schematic diagram of one power supply arrangement for the plasma wave tube.

One possible power supply circuit for driving the cold-cathodes 14, 16 is shown in FIG. 4. A rather weak, DC keep-alive discharge is maintained at about 15 mA with a small 1.5 kV power supply 52, which is connected to the cathodes through a high impedance resistor R1 and a much lower impedance resistor R2 to provide low-jitter, on-command triggering of the pulsed discharge used to generate the electromagnetic radiation. The discharge pulses themselves are formed by charging a capacitor 54 with a power supply 56 in the 4–20 kV range, preferably about 5 kV, through a high impedance resistor R3. The capacitor is discharged into the cathodes through a small thyratron switch 58, which is operated by a switch control mechanism 60 to apply pulses to the cathodes at a desired rate, and permit the capacitor to recharge between pulses. The waveguide walls, which act as an anode, are held at a reference voltage relative to the cathodes, preferably ground potential.

During initial operation, the plasma discharge is voltage regulating at about 200–1,000 volts, as discussed above, and the current must be limited by series resistor R2. After several hours of operation at a 1 Hz pulse repetition rate, however, the hydrogen discharge within the waveguide conditions the cathode surfaces so that the secondary electron yield is lowered, and the discharge impedance is increased well over the 50 ohm impedance of the discharge power supply. The plasma discharge then appears as a resistive rather than a voltage regulating phenomenon, and the value of the discharge resistance can be controlled by adjusting the magnetic field strength.

The circuit of FIG. 4 yields an electromagnetic radiation output that is characterized by a dynamic radiation frequency which varies over the period of each capacitor pulse. The frequency increases with the square root of the plasma density, and two opposing dynamic factors are at work which yield a net increasing frequency characteristic during each pulse. Beginning with essentially no plasma in the waveguide immediately prior to a capacitor pulse, the pulsed electron beams produce a progressive build-up of plasma when a voltage pulse is applied. This causes the plasma density to progressively increase, thereby increasing the output electromagnetic frequency. Opposing this frequency increase is the fact that the capacitor is discharging over the period of the pulse, causing the cathode voltages to progressively decrease, and thereby limit the beam currents. The net effect is an upward frequency sweep at a rate which can be controlled by the selection of the capacitor. The thyratron switch could be replaced by a current-voltage regulator, such as a MOSFET transistor circuit, that is capable of rapidly slewing the current and voltage applied to the cathodes.

Figure 5:
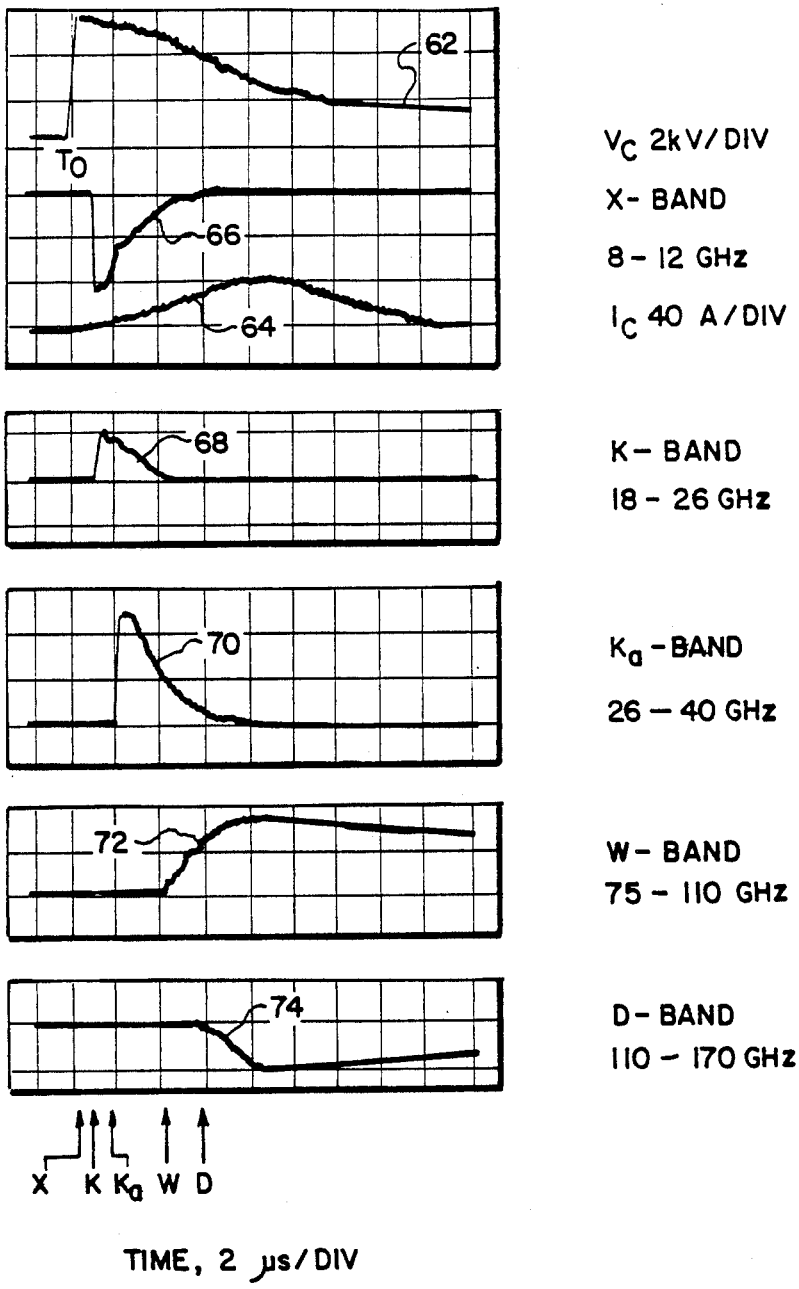
FIG. 5 is a series of graphs showing the frequency response in a chirping operation.

FIG. 5 shows oscillograms of the discharge voltage and current waveforms, together with waveforms of the output radiation measured with crystal frequency detectors over a 20 microsecond period. A very broad range of frequency change is accomplished over this short period. At any instant the output frequency is observed to be fairly narrow band, spanning a frequency range of roughly 10% of the center frequency. This frequency band is believed to result from density gradients in the plasma. In theory, it could be narrowed to a single frequency at any given time if plasma density gradients could be totally avoided.

The thyratron switch closes at time $T_0$ and the negative cathode shown in trace 62 quickly rises to 5 kV, and then decays as the capacitor discharges into the cathodes. The cathode current (current discharge) slowly rises along trace 64 over a period of about 8 microseconds to a value of about 40 amps. As the current rises, the plasma density and plasma frequency increase. Consequently, the frequency of the output electromagnetic radiation increases with time as well; periodic pulses of this type result in frequency "chirping".

The frequency of the waveguide radiation was observed in an experimental device with frequency detectors set to different defined frequency bands. Trace 66 shows the X-band (8–12 GHz) detector turning on at about 0.8 microseconds after the beginning of the voltage pulse, with the K-band (18–26 GHz) detector turning on shortly thereafter (trace 68). The value of the cathode current at this time was only about 1 amp, and the radiation frequency measurements indicated that the plasma density was already about $10^{12}$ $cm^{-3}$. As the cathode current continued to rise, the $K_a$-band (26–40 GHz), W-band (75–110 GHz) and D-band (110–170 GHz) detectors turned on in sequence, as shown by traces 70, 72 and 74, respectively. The decay of the lower frequency waveforms indicates that the device actually radiated at only a narrow frequency band at any given instant of time. At 6 microseconds after the beginning of the pulse, with the current at about 30 amps, the output radiation frequency reached about 140 GHz, or 2 mm wavelength radiation.

Figure 6:
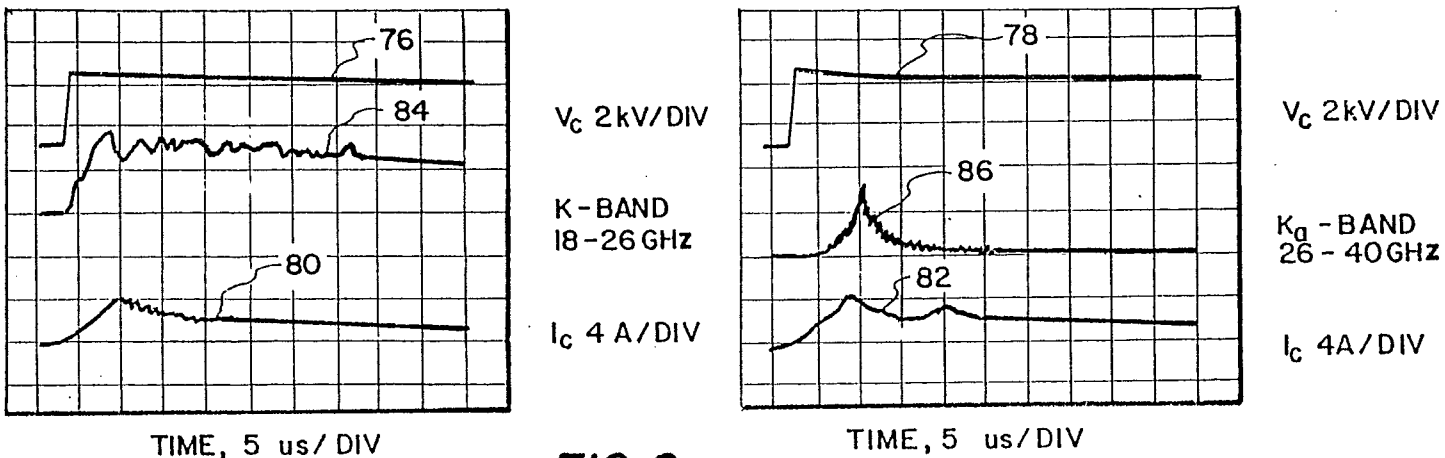
FIG. 6 is a series of graphs showing the frequency response in a generally constant frequency operation.

The results of FIG. 5 illustrate operation in a frequency chirped mode, in which the discharge current changes rapidly with time. The device can also be operated as a frequency-stabilized source by controlling the discharge current. This can be achieved with the use of a lower magnetic field to increase the discharge impedance, such that the current changes very slowly with time. The results of operating in this regime are illustrated by the graphs of FIG. 6. The cathode voltage is shown by traces 76 and 78, the cathode discharge current by traces 80 and 82, the K-band (18–26 GHz) detector response by trace 84, and the $K_a$-band (26–40 GHz) detector response by trace 86. The current is now seen to be much lower, and the K-band detector signal is almost flat in time. When the current peaks, however, the output frequency just barely reaches into the $K_a$-band range, and then decays back to the K-level as the current slowly falls. A dip in the K-band signal coincident with the $K_a$-band peak gives further evidence of very narrow band frequency output.

These experimental results demonstrate unique capabilities, including broad tunability, compact packaging, low voltage operation and simple, rugged mechanical design, which are not provided by other mm-wave sources. Since numerous variations and alternate embodiments will occur to those skilled in the art, it is intended that the invention be limited in terms of the appended claims.

I claim:

1. A plasma wave tube, comprising:

a waveguide housing, means for confining an ionizable gas within said housing, electron beam generating means mounted on opposed walls of the waveguide housing for generating a pair of counterpropagating electron beams through the gas confined within the housing at a voltage relative to the waveguide housing of at least about 4 kV, thereby forming a pair of electrostatic plasma waves which are mutually coupled into a waveguide mode to emit electromagnetic radiation within the waveguide, means for establishing a magnetic field within the waveguide to confine the plasma established by the electron beams and maintain the beam impedance high enough to sustain said beam voltage, and an output means at an end of the waveguide housing for coupling the electromagnetic radiation out of the waveguide housing in a direction along the length of the waveguide.

2. The plasma wave tube of claim 1, further comprising means for varying the plasma density, and thereby the frequency of the emitted electromagnetic radiation.

3. The plasma wave tube of claim 2, said electron beam generating means comprising a cold-cathode Penning discharge means for each beam, and said means for varying the plasma density comprising a circuit for varying the cathode voltage and current of each discharge means.

4. The plasma wave tube of claim 1, said electron beam generating means comprising a cold-cathode Penning discharge means for each beam.

5. The plasma wave tube of claim 1, said electron beam generating means generating their respective beams at a voltage relative to the waveguide housing within the approximate range of 4 kV-20 kV.

6. The plasma wave tube of claim 5, said electron beam generating means generating their respective beams with current densities of at least about 1 amp/$cm^2$.

7. The plasma wave tube of claim 1, said gas confining means comprising means for confining a gas within the waveguide housing at a pressure within the approximate range of 1–100 mTorr.

8. The plasma wave tube of claim 7, wherein the gas pressure is in the approximate range of 10–30 mTorr.

9. The plasma wave tube of claim 1, said waveguide housing comprising a tube which is closed at one end, said electron beam generating means discharging said beams into said tube in the vicinity of said closed end so that at least some of the emitted electromagnetic radiation is reflected off said closed end.

10. The plasma wave tube of claim 1, wherein said magnetic field is within the approximate range of 100–500 Gauss.

11. A plasma wave tube, comprising:

a rectangular waveguide housing, means for confining an ionizable gas within said housing at a pressure in the approximate range of 1–100 mTorr, a pair of cold-cathode Penning electron beam generators mounted on opposed walls of the waveguide housing across the narrow dimension of the rectangular waveguide to discharge counterpropagating electron beams through said gas, means for maintaining the waveguide housing at a reference anode voltage, power supply means connected to apply a voltage within the approximate range of 4–20 kV to the cathodes of said beam generators, said beams establishing a plasma within said gas and mutually coupling with said plasma to excite a fundamental waveguide mode and emit electromagnetic radiation within the waveguide, said radiation propagating along the length of the waveguide in a direction perpendicular to the counterstreaming electron beams, and a magnet positioned outside of said waveguide housing with said waveguide housing and said electron beam generators positioned in the gap of said magnet to establish a magnetic field within the housing between said beam generators in the approximate range of 100–500 Gauss.

12. The plasma wave tube of claim 11, said power supply including means for varying the voltage applied to said cathodes, and thereby the frequency of the emitted electromagnetic radiation.

13. The plasma wave tube of claim 12, said power supply comprising a first voltage source connected to apply a voltage to said cathodes of less than 4 kV but sufficient to maintain said electron beams when electromagnetic radiation is not desired, a capacitive discharge circuit, a second voltage source charging said discharge circuit to a voltage of at least about 4 kV, and a switch connecting said discharge circuit to said cathodes when electromagnetic radiation is desired.

14. The plasma wave tube of claim 11, said beam generators discharging electron beams with a current density of at least about 1 amp/cm$^2$ at said voltage.

15. The plasma wave tube of claim 11, said waveguide housing comprising a tube which is closed at one end, said electron beam generators discharging their beams into said tube in the vicinity of said closed end so that at least some of the emitted electromagnetic radiation is reflected off said closed end.

16. The plasma wave tube of claim 15, said waveguide housing comprising a substantially rectangular tube with two opposed walls longer than the other two opposed walls, said electron beam generators being mounted to the longer walls so that said electromagnetic radiation is transmitted through the waveguide in the $TE_{10}$ mode.

17. A method of establishing an electromagnetic waveguide transmission, comprising:

confining an ionizable gas within a waveguide housing, directing a pair of counterpropagating electron beams through said gas at a voltage of at least about 4 kV, with a current density of at least about 1 amp/cm$^2$ by applying operating voltages to the cathodes of respective cold-cathode Penning electron beam generators, whereby said beams form a plasma within said gas and mutually couple with said plasma to emit electromagnetic radiation within the waveguide, varying the plasma density in part by varying said cathode voltages and thereby varying the frequency of the emitted electromagnetic radiation over time, and establishing a magnetic field generally parallel with said beams to confine the plasma to the vicinity of said beams and maintain the beam impedance high enough to sustain said beam voltage.

18. The method of claim 17, wherein said beam voltage is in the approximate range of 4–20 kV.

19. The method of claim 17, wherein said gas is confined within the waveguide housing at a pressure in the approximate range of 1–100 mTorr.

20. The method of claim 19, wherein said gas is confined within the waveguide housing at a pressure in the approximate range of 10–30 mTorr.

21. The method of claim 17, wherein the strength of said magnetic field is within the approximate range of 100–500 Gauss.

* * * * *